United States Patent [19]

Christopher

[11] 4,368,719

[45] Jan. 18, 1983

[54] ARCHERY CLICKER

[76] Inventor: John Christopher, 2321 Grant, Blair, Nebr. 68008

[21] Appl. No.: 206,683

[22] Filed: Nov. 13, 1980

[51] Int. Cl.[3] ..... F41B 5/00

[52] U.S. Cl. ..... 124/88; 116/67 R; 124/DIG. 1

[58] Field of Search ..... 124/23 R, 24 R, 26, 124/35 A, 41 A, 88; 116/67 R

[56] References Cited

U.S. PATENT DOCUMENTS

| | | | |
|---|---|---|---|
| 3,097,624 | 7/1963 | Bergquist | 124/23 R X |
| 3,443,558 | 5/1969 | Peck | 124/24 R |
| 3,499,414 | 3/1970 | Frydenlund | 124/24 R X |
| 3,518,959 | 7/1970 | Bunker | 124/24 R X |
| 3,669,059 | 6/1972 | Stuart | 124/88 X |
| 3,866,592 | 2/1975 | Carella | 124/24 R |
| 3,867,920 | 2/1975 | Westphal | 124/24 R |
| 4,061,107 | 12/1977 | Smith | 124/23 R X |
| 4,134,383 | 1/1979 | Flood | 124/24 R |

*Primary Examiner*—Richard C. Pinkham
*Assistant Examiner*—William R. Browne
*Attorney, Agent, or Firm*—Cushman, Darby & Cushman

[57] ABSTRACT

A clicker is shown for giving an audible signal when an archer's bow string is properly tensioned. The clicker is mounted at the end of an elongated cable guard extension rod to cooperate with the rear edge of the connecting section of the string of a compound bow when the operative section of the string has been moved to its rearmost position, to indicate when the desired tension has been drawn in the string for shooting the arrow.

16 Claims, 6 Drawing Figures

3
14
16
18
24
25
26
31
30
24
46
3
13
12

12
13
10

ARCHERY CLICKER

BACKGROUND

Archery is a very demanding sport and very sophisticated equipment has been provided for shooting an arrow toward its target. A most critical factor in determining the accuracy of the shot is the force imparted to the arrow upon release of the tensioned bow string. To insure a uniform flight for all of the arrows shot from a bow, various devices have been proposed for measuring the degree of tension produced in the bow string upon pulling it rearwardly to stress the bow, the most common being indicating devices that measure the position of the tip of the arrow relative to the arrow guide rest as each arrow is pulled back when the string is drawn rearwardly. U.S. Pat. Nos. 3,499,414 to Frydenlund; 3,518,959 to Bunker; 3,669,059 to Stuart and 4,061,107 to Smith are examples of known devices for producing an audible signal when the arrowhead reaches the arrow guide rest and the bow string has been retracted a uniform distance for each arrow and is ready for release.

These known clicker devices bear against the side of the arrow at its tip end and provide an audible snap when a spring powered feeler is released. While, of course, the feeler means is designed to move beyond the path of the arrow in its flight, depending upon the construction of the arrow itself, the stabilizing feathers or other portion of the arrow may have a slight but nonetheless deleterious contact with such means located in the direct line of the flight path of the arrow.

Other known devices to produce a signal indicating when the desired tension has been drawn in the string are shown in U.S. Pat. Nos. 3,097,625 to Berquist; 3,867,920 to Westphal and 4,134,383 to Flood. The Berquist teaching makes use of the bending of the bow structure itself to operate a cricket snapper device, Westphal shows an electrical circuit make and break for lighting a signal light and Flood also shows a light indicator located on the bow which the archer must observe either consciously or subconsciously while pulling the string and simultaneously sighting the arrow to effect a proper release.

BRIEF DESCRIPTION OF THIS INVENTION

The present invention departs from all of these known string tension measuring and string position indicating means for archers using a compound bow having an operative string element and connector string portions by providing a telltale click activated by movement of one of the connector string portions to its rearmost position at which time it is known that the desired tension has been produced in the operative string element by the bow to project the arrow on its flight. As the string of the bow is drawn back and the tip of the arrow moves onto the arrow guide rest in position to be shot, the rear surface of one of the connector string portions reaches its fully retracted position and at that instant a clicker mounted at the rearmost end of a cable guard extension rod that is positioned to be activated by contact of the rearside of the one connector string, is engaged by the string to release the cocked spring snapper to provide the telltale click. Upon release of the arrow, the tensioned operative string element projects the arrow on its flight. The connector string portions also move forwardly and the one portion used to trip the snapper spring, moves away from its contact with the clicker means and there is no part of the clicker device that can engage the connector portions or operative element of the string or any part of the arrow once the operative element of the string has been released so that the true flight of the arrow as determined only by the skill of the archer, is insured without fear of any extraneous contact of the clicker with the string or the arrow.

Not only are the arrow in flight and the string isolated from any contact with the tension measuring means, but the indicator is positioned to provide the most exact tension measurement possible as determined by the rearmost position of one of the connector portions of the string. When the clicker is mounted at the rearmost end of the cable guard extension rod, as soon as the operative element of the string is moved to its fully tensioned position, with the device here shown, the spring clicker means is released by contact with the backside of a connector portion of the string itself. This position of the clicker permits it to coact with the rear of that portion of the string at the exact same rearward position of the connector string with each pull of the operative element of the string with an arrow on the bow so that the fastest reaction between the string and clicker results, whereby a most accurate indication of the uniformity of each string pull is produced.

It is therefore an object of this invention to provide an improved bow clicker device.

Another object is to provide a clicker located in a position where once the drawn bow string is released, the arrow and string can have no contact with this added clicker device.

Another object is to provide a clicker positioned to coact with the rear portion of a connector portion of the string itself once the operative portion of the string has been drawn to the desired tension.

Another object is to provide a clicker situated in a position remote from the arrowhead and one that does not detract from the aiming process.

Another object is to permit the use of any type arrow point.

Another object is to permit the use of any length arrow.

Other objects will appear from the specification below.

IN THE DRAWINGS

DETAILED DESCRIPTION

Figures 1, 2:
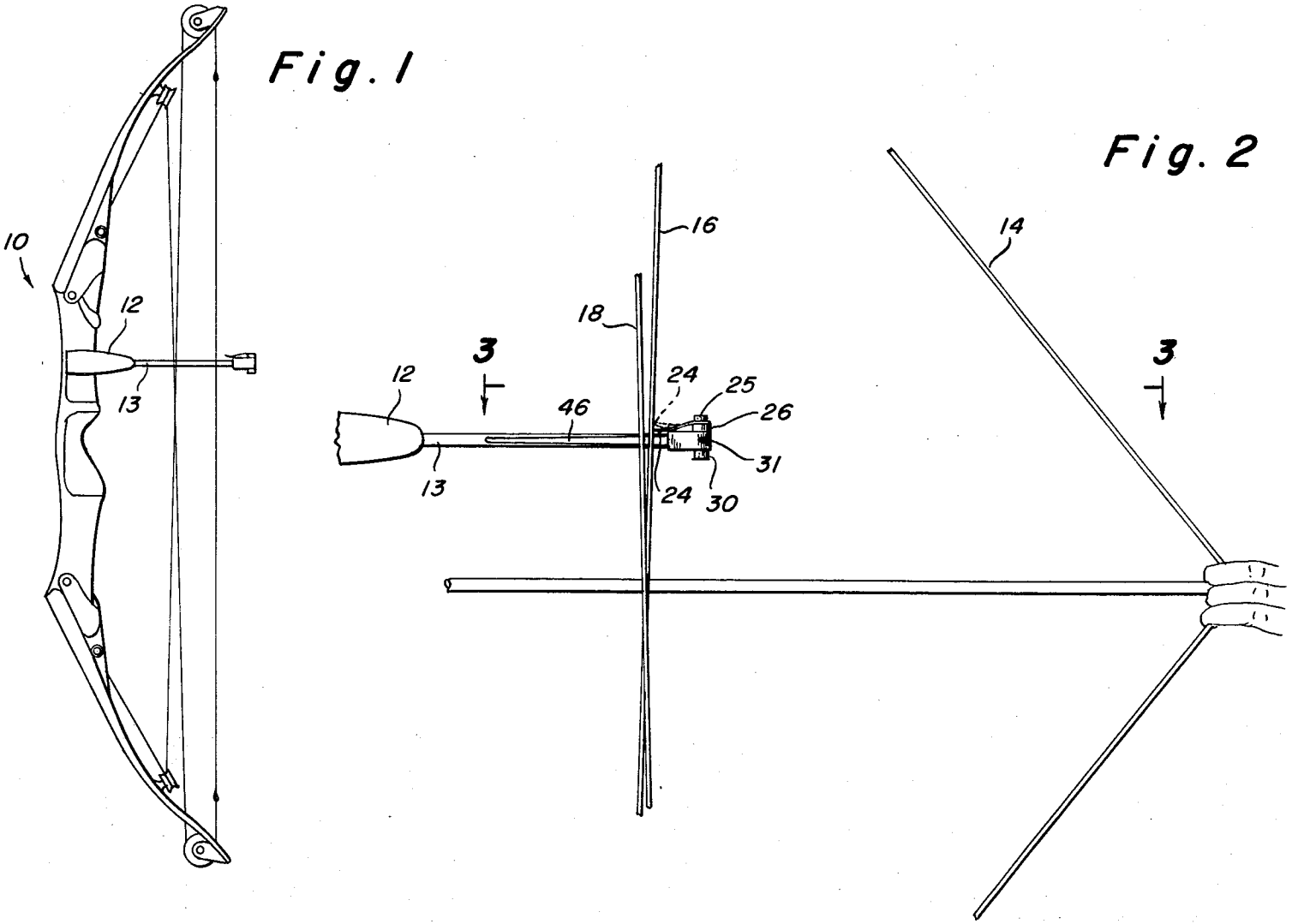
FIG. 1 is an assembly showing the clicker of this invention mounted on a compound bow construction.
FIG. 2 is a view similar to FIG. 1 but with the operative section of the string fully retracted with the arrow, about to be released, showing the clicker cocked in dotted lines and snapped in solid lines.

The clicker of this invention is shown mounted on a compound bow 10 at the rearmost end of a cable guard 12 carrying extension rod 13, the guard being mounted at its front end on the bow. The bow is provided with a string having an operative string section 14 to which the arrow is fitted and connector ends 16 and 18. The connector sections 16 and 18 pass over pulleys at intermediate points along the bow and the free ends of these connector sections are attached to the bow in the conventional manner. The cable guard attaching plate is fixedly mounted on the bow adjacent to but spaced away from the arrow guide rest and supports the integral rearwardly extending rod 13 that passes between the pair of connector sections 16 and 18 disposed on one side of the rod and the operative section of the string disposed on the other side. The clicker means of this invention is mounted at the rearmost end of rod 13 in position to cooperate with the rear edge of the connector section 16 when the operative section 14 has been retracted to the desired position for shooting the arrow by tensioning the string.

Figure 3:
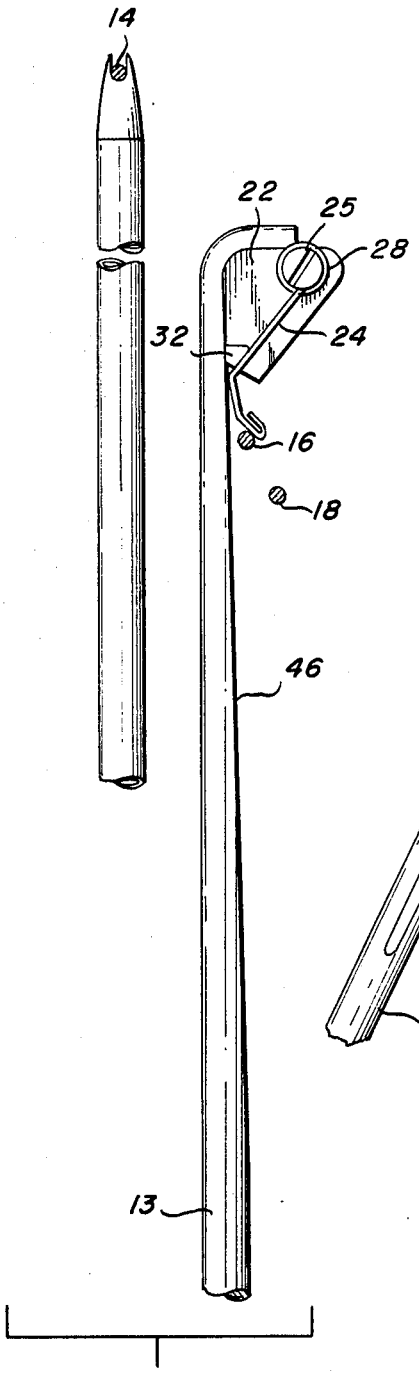
FIG. 3 is a detailed view of the clicker and bow string arrangement looking on line 3—3 of FIG. 2, showing the connector portion of the string moving into contact with the spring feeler.
Figure 4:
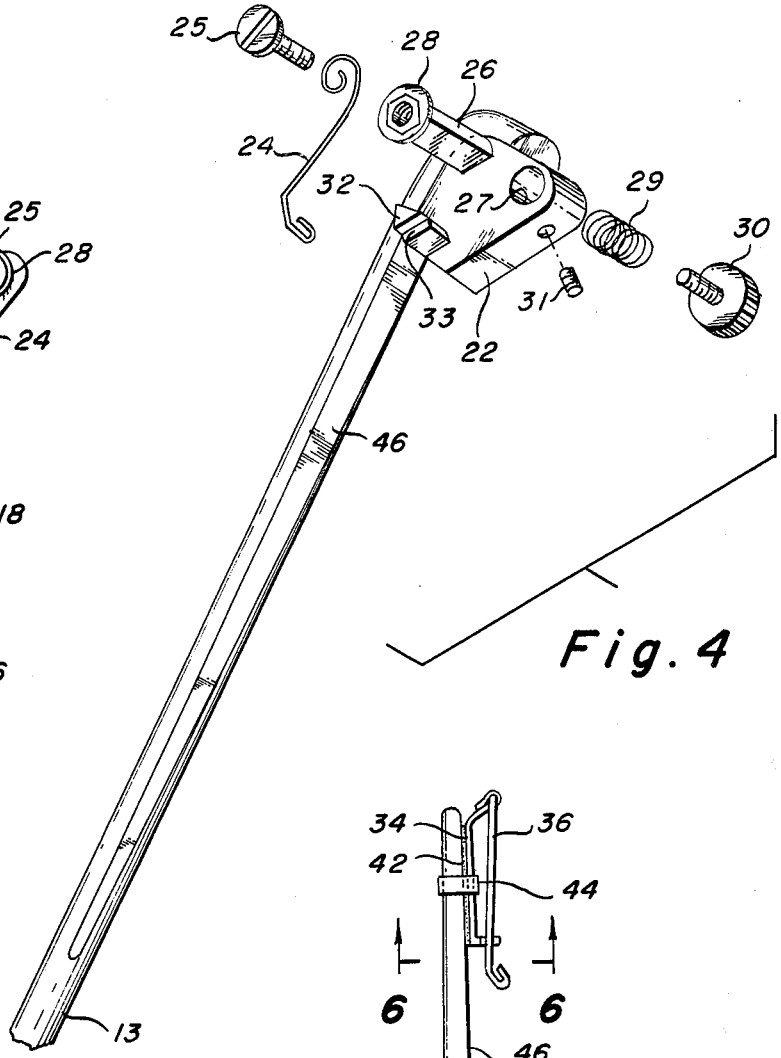
FIG. 4 is an exploded perspective detailed view of the clicker device mounted at the rear end of the rod extension of the guard means.

The clicker includes a body 22 adapted to be permanently mounted on the rear end of rod 13 and on the same side of rod 13 as the connecting sections 16 and 18 of the string, as best shown in FIG. 3, to support an elongated spring 24 in position such that the cam-shaped free end of the spring can be engaged by the rear edge of connector string 16 when the operative section 14 of the string is fully retracted. The clicker spring is preferably formed of a spring wire shaped to be mounted by screw 25 on the top end on the post or bushing 26 that is fitted into an aperture 27 through body 22 to be adjustable vertrically to change the tension for driving spring 24 as it snaps against body 22, as will appear more fully below.

The post 26 has a shoulder 28 integral at its upper end to trap spring 29 between the shoulder and body 22 and a knurled threaded means 30 engages the underside of the body to adjust post 26 more or less vertically through aperture 27. A set screw 31 may be provided to hold the post in its adjusted position. Alternatively, the post 26 and the aperture may be non-circular in cross-section, e.g. hexagonal, in which case the set screw 31 can be omitted.

A support post 32 is formed integral with the front end of body 22, the post having a step 33 formed on its side face to support the front end of spring 24 spaced upwardly or above body 22 when the snapper is cocked, as shown in FIG. 1.

As above stated, the rear end of spring 24 is fixed to the upper end of bushing 26 and the spring extends forwardly over the clicker body 22. The forward end of the spring has a smooth cam shape to be engaged by the rear edge of the connector portion 16 of the string as the operative portion of the string is retracted so that after the free front end of the spring has been set on the step 33 above the body 22 in its cocked position, it can be tripped as the connector string pushes the spring off of the step to allow it to snap onto body 22 from the dotted line position shown in FIG. 2, to the full line position to produce an audible click when the spring is released.

The spring is held in a cocked position on the suitably positioned step or rest 33 to which it is moved prior to fitting the arrow to the operative section of the string. The free end of the spring seated on the rest is spaced somewhat from and is positioned over a snap landing zone on the body 22 so that when it is released from the rest, it drives against the landing zone to produce the audible click desired to notify the archer that the operative section of the string 14 has been drawn to the desired rearmost position to cause connector string 16 to force the spring from seat 33. As the operative section is pulled to the same rearmost position as each arrow is drawn, the clicker measures the same length of draw or rearward movement for the connector string section 16. It is apparent that this arrangement provides for a quite uniform clicker action whereby a true flight for each of the respective arrows results from the use of this device.

The snapping tension may be adjusted in the spring 24 by the vertical adjustment of the post 26 as described above in order to control the noise produced by the snapping of spring 24 against the landing zone on body 22. The step or rest 33 and snap landing zone are preferably formed integral with the body 22.

Figure 5:
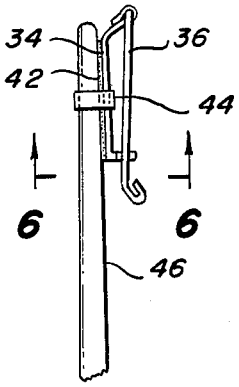
FIG. 5 is a plan view an alternate form of a clicker body shown mounted on a bow as in FIG. 3.
Figure 6:
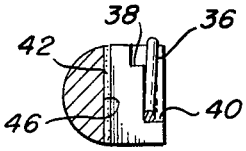
FIG. 6 is a detailed view looking on line 6—6 of FIG. 5.

The body 22 may be formed of a block of aluminum or the like and may be permanently adhesively attached to the end of rod 13 or it may be removably bolted onto the rod. As shown in FIG. 5, an alternate spring supporting body may be formed of a stamped metal shape 34. The spring 36 of this form of the clicker is permanently fixed to the rear end body 34 by a crimping operation and the forwardly directed free end is designed to have a cam shape end to be seated in cocked position on a suitable rest 38 above a snapper landing zone 40 for operation as above described, in connection with spring 24.

The body 34 of this clicker is adapted to be adhesively bonded in place on the rear end of rod 13 with a two-way adhesive tape 42 and a rubber band 44, if needed, so that it may be easily removed during competition.

In the preferred form of the invention, the rear portion of rod 13 may be ground smooth as indicated at 46. This surface serves to engage with connector string element 16 as it moves rearwardly to guide the string smoothly into contact with the cam-shaped front end of the spring.

The operation of the clicker means here shown is initiated by manually stressing the spring 24 and placing its free end in its cocked position on rest 33 or 38 as the case may be. The cam-shaped free end of the spring projects beyond the rest upon which the spring is frictionally seated and is positioned to be engaged by the rear edge of the connecting section 16 of the string. When operative section of the string is drawn rearwardly with the arrow and has reached its rearmost position, the bending of the bow moves the rear edge of the connector section of the string 16 into engagement with the snapper spring. At the exact distance from the bow where the operative section 14 of the string has been fully drawn, the backside of the connecting section 16 of the string engages the cam surface of the end of the spring to move it off of its seat so that it snaps against the snap landing zone on the spring supporting body. The archer knows that at this instant, the bow tension has reached the desired maximum and with each pull, the same position of the operative section 14, as determined by the position of the connecting section 16 of the string, is identified with each repetative operation of the clicker so that a uniform tension is indicated for shooting each of the respective arrows. The engagement between the backside of the connecting section 16 of the string and the cam surface of the clicker spring provides the most accurate indication possible for identifying the fully drawn position of the operative section without contact with the arrow or any of the other elements of the bow that might affect the flight of the arrow, however slight, as has been customary heretofore, so that greater accuracy is assured. Further, the clicker means and connecting string here shown and described is positioned behind the cable guard while the arrow and operative section of the string are on the other side whereby upon release of the arrow, the clicker can have no contact whatsoever with either the arrow or the operative section 14 of the string so that all possibility of inadvertent interference with movement of the operative section of the string or the flight of the arrow is precluded.

While the term bow string has been used in the description above, all flexible types of strings, cables, twisted strands and the like, normally used with resilient compound bow structures are contemplated to fall within the description of string.

The above description covers the preferred form of this invention; it is possible that modifications thereof may occur to those skilled in the art, that will fall within the scope of the following claims.

I claim:

1. A clicker adapted for use with a compound bow and positioned for interacting with the rearside of a connecting section of the bow string, comprising an elongated cable guard extension rod mountable on the bow to extend rearwardly therefrom between the operative section and connecting sections of the bow string; a clicker body mounted on the rearmost end of said rod; an elongated spring carried at one end on said body; spring rest means to support the other end of said spring in a stressed position; a snap landing zone for the spring adjacent said spring rest; said other end of the spring being cam-shaped to engage with a connecting section of the bow string and being supported in a cocked position on the rest in the path through which the connecting section of the string moves when the archer pulls the operative section of the string to shoot an arrow whereby the engagement of the connecting section of the string against the cam-shaped end of the spring moves the spring from said rest so that said cam-shaped end of the spring snaps against said snap landing zone to produce an audible signal when the operative section of the string has been drawn rearwardly a measured distance to produce the desired tension for shooting an arrow.

2. A clicker as in claim 1 wherein the tension of said spring may be adjusted to increase or diminish the noise of the audible signal.

3. A clicker as in claim 1 wherein said spring is an elongated shaped wire element.

4. A clicker as in claim 1 wherein said spring rest is integral with said clicker body.

5. A clicker as in claim 4 wherein said snap landing zone is also integral with said body.

6. A clicker as in claim 5 wherein said body is formed of aluminum.

7. A clicker as in claim 1 wherein said snap landing zone is integral with said body.

8. A clicker as in claim 1 wherein said spring is carried on a bushing, said bushing being mounted in an aperture passing through said body.

9. A clicker as in claim 8 wherein said bushing may be moved longitudinally in said aperture for adjustment to vary the tension of said spring to control the noise produced by the snap action of the spring.

10. A clicker as in claim 9 wherein means are provided to hold said bushing in a fixed adjusted position.

11. A clicker as in any of claims 1 or 4 or 5 wherein said body is removably mounted on said rod.

12. A clicker as in claim 1 wherein said rod has a ground bearing surface provided thereon to guide said connecting section of the string into engagement with said cam-shaped end of the spring.

13. A clicker for use with a compound bow which includes a bow string having an operative section adapted to be engaged by an arrow and connecting sections passing over pulleys carried by the bow, said clicker comprising: a clicker body; support means connected to said clicker body and adapted to be connected to the bow in a manner to locate said body in a position rearwardly of the bow string connecting sections; and clicker means carried by said body for producing an audible click when the operative section of the bow string has been drawn rearwardly to produce a desired tension for shooting an arrow, said clicker means being adapted to produce its audible click in response to being engaged by rearward movement of a connecting bow string connecting section during rearward drawing of the operative bow string section.

14. A clicker as in claim 13 wherein said support means includes an elongated rod connected at one end to said clicker body and adapted to be connected at its other end to the bow.

15. A clicker as in claim 13 wherein the bow includes a cable guard connected thereto and wherein said support means includes an elongated rod connected at one end to said clicker body and adapted to be connected at its other end to the cable guard.

16. A clicker as in claims 14 or 15 wherein said rod has a smooth bearing surface provided thereon to guide the bow string connecting sections into engagement with said clicker means.

* * * * *